US005464528A

United States Patent [19]

Owen et al.

[11] Patent Number: 5,464,528

[45] Date of Patent: Nov. 7, 1995

[54] FCC PROCESS AND APPARATUS WITH UPSET TOLERANT THIRD STAGE SEPARATOR

[75] Inventors: Hartley Owen, Worton, Md.; Paul H. Schipper, Doylestown, Pa.

[73] Assignee: Mobil Oil Corporation, Fairfax, Va.

[21] Appl. No.: 175,864

[22] Filed: Dec. 30, 1993

[51] Int. Cl.[6] ..... C10G 11/18

[52] U.S. Cl. ..... 208/161; 208/113; 208/164; 502/21; 502/41; 502/42

[58] Field of Search ..... 502/21, 41–44; 208/161, 164, 113

[56] References Cited

U.S. PATENT DOCUMENTS

| | | | |
|---|---|---|---|
| 2,687,780 | 8/1954 | Culhane | 55/349 |
| 4,176,083 | 11/1979 | McGovern et al. | 502/34 |
| 4,285,706 | 8/1981 | Dehne | 55/343 |
| 4,392,345 | 7/1983 | Geary, Jr. | 60/39.02 |
| 4,521,389 | 6/1985 | Blanton, Jr. | 502/42 |
| 4,687,497 | 8/1987 | Owen et al. | 55/349 |
| 4,755,282 | 7/1988 | Samish et al. | 208/113 |

*Primary Examiner*—Anthony McFarlane
*Attorney, Agent, or Firm*—Alexander J. McKillop; Malcolm D. Keen; Richard D. Stone

[57] ABSTRACT

An inertial/filtering separator in a single vessel and FCC process using same as a third stage separator are disclosed. Gas and fines are added tangentially to an annulus formed by a cylindrical insert in a vessel. Gas flows over the insert and down to filters in the vessel. Solids are withdrawn from the base of the annulus and periodically from the filter. Three types of solids collection—inertial, gravity settling and filtration—are practiced in a single vessel.

9 Claims, 3 Drawing Sheets

FCC PROCESS AND APPARATUS WITH UPSET TOLERANT THIRD STAGE SEPARATOR

BACKGROUND OF THE INVENTION

1. Field of the Invention

The field of the invention is fluidized catalytic cracking of heavy hydrocarbon feeds and separating fine solids from vapor streams.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.–600° C., usually 460° C.–560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.–900° C., usually 600° C.–750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. Modern fluid catalytic cracking (FCC) units use zeolite catalysts. Zeolite-containing catalysts work best when coke on the catalyst after regeneration is less than 0.1 wt %, and preferably less than 0.05 wt %.

To regenerate FCC catalyst to this low residual carbon level and to burn CO completely to CO2 within the regenerator (to conserve heat and reduce air pollution) many FCC operators add a CO combustion promoter. U.S. Pat. Nos. 4,072,600 and 4,093,535, incorporated by reference, teach use of combustion-promoting metals such as Pt, Pd, Ir, Rh, Os, Ru and Re in cracking catalysts in concentrations of 0.01 to 50 ppm, based on total catalyst inventory.

Most FCC's units are all riser cracking units. This is more selective than dense bed cracking. Refiners maximize riser cracking benefits by going to shorter residence times, and higher temperatures. The higher temperatures cause some thermal cracking, which if allowed to continue would eventually convert all the feed to coke and dry gas. Shorter reactor residence times in theory would reduce thermal cracking, but the higher temperatures associated with modern units created the conditions needed to crack thermally the feed. We believed that refiners, in maximizing catalytic conversion of feed and minimizing thermal cracking of feed, resorted to conditions which achieved the desired results in the reactor, but caused other problems which could lead to unplanned shutdowns.

Modern FCC units must run at high throughput, and run for years between shutdowns, to be profitable. Much of the output of the FCC is needed in downstream processing units. Most of a refineries gasoline pool is usually derived directly from the FCC unit. It is important that the unit operate reliably for years, and be able to accommodate a variety of feeds, including very heavy feeds. The unit must operate without exceeding local limits on pollutants or particulates. The catalyst is somewhat expensive, and most units have several hundred tons of catalyst in inventory. Most FCC units circulate tons of catalyst per minute, the large circulation being necessary because the feed rates are large and for every ton of oil cracked roughly 5 tons of catalyst are needed.

These large amounts of catalyst must be removed from cracked products lest the heavy hydrocarbon products be contaminated with catalyst and fines. Catalyst and fines must also be removed from flue gas discharged from the regenerator. Any catalyst not recovered by the regenerator cyclones stays with the flue gas, unless an electrostatic precipitator, bag house, or some sort of removal stage is added at considerable cost. The amount of fines in most FCC flue gas streams exiting the regenerator is enough to cause severe erosion of turbine blades if a power recovery system is installed to try to recover some of the energy in the regenerator flue gas stream.

The solids remaining at this point are exceedingly difficult to recover, having successfully avoided capture despite having passed through several stages of highly efficient cyclones. The solids are very small, essentially all of the solids are below 20 microns, and including significant amounts of sub-micron and micron to under 5 micron material.

Recovery of such solids has been a challenge for almost a century. A survey of the state of the art is described in Perry's Chemical Engineering Handbook, in DUST-COLLECTION EQUIPMENT, abstracted hereafter. A gravity settling chamber could be used, but generally only works for particles larger than about 40 microns in diameter. Small particles have a long settling time and are swept out before they settle, unless the device has a large cross-sectional area.

The Howard dust chamber improved things a bit by providing multiple horizontal plates in the chamber, so that the dust did not have so far to fall. This arrangement is shown in U.S. Pat. No. 896,111, 1908. For an FCC regenerator, with large volumes of regenerator air, and large amounts of fines and dust, a settling chamber with a larger footprint than the entire FCC unit including main fractionator would be required.

Impingement separators improved things a bit, by using inertial forces to drive particles to impinge on collecting bodies in the gas stream. These work well for particles above 20 microns, but have little effect on the dust in FCC regenerator flue gas.

Cyclone separators are settling chambers in which gravitational acceleration is replaced by centrifugal acceleration. FCC regenerators use large cyclone separators, and are able to efficiently recover essentially particles larger than about 5 microns. Collection efficiency is poor for smaller than 5 micron sized particles, and very poor for anything smaller than 2 or 3 microns. To increase collection efficiency in FCC regenerator cyclones, refiners have accepted higher pressure drops and forced incoming gas to make 4 or 5 turns in the cyclone.

Refiners with large FCC units typically use 6–8 primary and 6–8 secondary cyclones in their FCC regenerators, because of mechanical constraints and pressure drop concerns. These inherently let a large amount of fines and dust, in the submicron to 2–3 micron size range, pass out with the flue gas. This material must be removed from the flue gas prior to discharge to the atmosphere, or passage through a power recovery turbine.

Generally a third stage separator is installed upstream of the turbine to reduce the catalyst. loading and protect the turbine blades, or permit discharge of flue gas to the air. When a third stage separator is used a fourth stage separator is typically used to process the underflow from the third stage separator. The fourth stage separator is generally a bag house.

Third stage separators typically have 50 or 100 or more small diameter cyclones. One type of third stage separator is described in "Improved hot-gas expanders for cat cracker flue gas" Hydrocarbon Processing, March 1976. The device is fairly large, a 26 foot diameter vessel. Catalyst laden flue gas passes through many swirl tubes. Catalyst is thrown against the tube wall by centrifugal force. Clean gas is withdrawn up via a central gas outlet tube while solids are discharged through two blowdown slots in the base of an outer tube. The device was required to remove most of the 10 micron and larger particles. The unit processed about 550,000 lbs. hour of flue gas containing 300 lbs hour of catalyst particles ranging from sub-micron to 60 micron sized particles.

Third stage separators are also shown in U.S. Pat. Nos. 4,285,706 and 4,755,282 which are incorporated by reference.

Third stage separators typically use large numbers of horizontally mounted small cyclones. This device is downstream of and external to the FCC regenerator. Several vendors (Polutrol and Emtrol) supply systems with many small diameter, horizontally mounted, closely connected and radially distributed cyclones about a central gas outlet.

Although third stage separators help, they have never been as efficient as desired, and do not respond well to large catalyst or pressure surges from the FCC regenerator. They also leave too much fines in the flue gas, and discharge too much gas with collected fines. Many refiners have had to install electrostatic precipitators or a baghouse on underflow downstream of the third stage separator to reduce fines emissions.

Conventional third stage separators, based on multiple cyclones, have other problems as well, one of the more significant being poor response to a catalyst load dump. If something goes seriously wrong in the FCC unit, e.g., a flow reversal when hydrocarbon feed enters the regenerator followed by massive amounts of steam quench, then all the catalyst in the regenerator can be lost. Thus if some event causes high catalyst losses, or low catalyst levels in the regenerator which expose the cyclone diplegs, the cyclones are effectively turned off, and all the catalyst is blown out. Essentially the entire catalyst inventory can be blown up the stack and settle over a period of hours or even days. When a power recovery turbine is used the turbine blades will be severely eroded by passage of massive amounts of catalyst through the turbines.

U.S. Pat. No. 4,392,345, incorporated by reference, discloses a way to control bypassing of flue gas around turbines when a catalyst load dump occurs.

We wanted a better third stage separator. We wanted to achieve a breakthrough in fines recovery, and come up with a robust design that could tolerate large catalyst or pressure surges without damaging turbines or distributing tons of catalyst across the countryside.

We believed that third stage separators based on cyclones were at their limit. The laws of physics made collection of fines and dust difficult. Going to multiple, small diameter cyclones helped, but was by no means a complete solution to the problem. They also responded poorly to catalyst surges, which are recurrent events.

Local environmental regulations generally prohibit intermittent, as well as continuous, discharge of particulates into the atmosphere. Power recovery turbine blades are degraded slowly by modest amounts of fines, and quickly by surges. We thus wanted a higher efficiency of fines recovery, and a way to tolerate sudden surges of fines and/or catalyst.

Electrostatic precipitators were a possibility, but even these were not so effective on micron and submicron particles. Precipitators are also large, expensive and require periodic shutdowns for maintenance.

We considered filtration. Filter elements, preferably sintered metal or ceramic, but possible including fabric filters, seemed to present the best possibility for a reliable, low maintenance, surge resistant system. The existing designs based on filtration had problems. Some refineries now use filters as a fourth stage separator feeding underflow from the 3rd stage separator, typically downstream of a third stage separator using small diameter cyclones.

In these fourth stage separators the flue gas discharges up into the center of a large vessel containing many filter elements. The filters are exposed to upsets in catalyst loading. If the filters are coated, or overloaded, with a thick layer of fines, the pressure drop across the filter elements can build rapidly, leading to a pressure surge which cascades upstream to the FCC regenerator or reactor. This can reduce FCC throughput or even shut down the regenerator air blower, which also shuts down the FCC unit.

We wanted to retain many elements of this design, but modify the way fines laden gas was added to improve the efficiency and reliability of the operation. We also wanted to eliminate most of the particulates emissions currently associated with FCC units. We believed we could even remove more than 90%, and up to 99% of the particulates emissions commonly generated by FCC units. Not only would this represent a substantial reduction in particulates emissions, it would also greatly improve the reliability of power recovery turbines, if present.

We discovered a way to use filtration to greatly improve third stage separation, and perhaps eliminate the need for a fourth stage separator. We discovered that adding gas via an annular inlet allowed a significant amount of inertial separation to occur upstream of the filter elements. It also allowed us to impose a generally downward flow of gas and fines as they flowed to the filter elements. An additional benefit is that radial out-to-in flow exposes the maximum surface area of filter elements to incoming gas, in contrast to the old approach with exposed the minimum amount of surface area. These relatively simple, and easy to implement, changes greatly improved the efficiency and reliability of the device.

We achieved a low grade of particulates removal via an initial inertial separation, and a measure of surge protection. We then used both downflow settling, and filtration, together, to remove an extraordinary amount of fines from a gas stream.

BRIEF SUMMARY OF THE INVENTION

The present invention provides a fluidized catalytic cracking process wherein a heavy feed is catalytically cracked to lighter products comprising: cracking said feed with a stream of regenerated cracking catalyst having an average particle size within the range of 60–80 microns in a cracking reactor to produce products and spent catalyst; separating products from spent catalyst; stripping spent catalyst with steam to produce stripped catalyst; regenerating said stripped catalyst in a catalyst regeneration means by contact with an oxygen containing gas to produce regenerated catalyst and flue gas containing entrained catalyst and fines; recycling to said cracking reactor said regenerated cracking catalyst; recovering entrained catalyst from flue gas by passing flue gas through at least one stage of cyclone separation to produce a regenerator flue gas which is essentially free of entrained catalyst having a particle size greater than 20 microns but containing entrained catalyst fines comprising micron and submicron sized particles; separating entrained fines from produced regenerator flue gas containing fines by inertial separation and filtration in a separator vessel having vertical cylindrical sidewalls, a diameter, a vertical axis, a top and a base; and a vertical cylindrical insert within the vessel having an insert diameter, a top, a bottom, and a vertical axis aligned with said vessel vertical axis and wherein the insert diameter is smaller than the vessel diameter, said insert forming an annulus between said insert and said cylindrical sidewalls of said vessel; at least one tangential vapor inlet for produced regenerator flue gas passing through said vessel cylindrical sidewalls into said annulus at an elevation between said top and said base of said cylindrical insert; a vapor overflow opening between the top of said insert and the top of said vessel for radial out-to-in vapor flow from said annulus into an upper, interior portion of said vessel; a solids underflow opening between the bottom of said insert and the bottom of said vessel for discharge of solids from said annulus into said bottom portion of said vessel; a plurality of filtration means within said vessel and within said insert, and wherein at least a portion of said filtration means are beneath said upper, interior portion of said vessel for downflow of at least a portion of vapor from said overflow opening to an outer surface of said filtration means; a vapor outlet for vapor with a reduced solids content connective with an interior portion of said filtration means and passing through said vessel; and a solids outlet in said base portion of said vessel.

In another embodiment, the present invention provides a fluidized catalytic cracking process wherein a heavy feed is catalytically cracked to lighter products comprising cracking said feed by contact with a stream of regenerated cracking catalyst having an average particle size within the range of 60–80 microns in a cracking reactor to produce cracked products and spent catalyst; separating products from spent catalyst; stripping spent catalyst with steam to produce stripped catalyst; regenerating said stripped catalyst in a catalyst regeneration means by contact with an oxygen containing gas to produce regenerated catalyst and flue gas containing entrained catalyst and fines; recovering entrained catalyst from regenerator flue gas by passage through at least one stage of cyclone separation to produce a regenerator flue gas which is essentially free of entrained catalyst having a particle size greater than 20 microns but containing entrained catalyst fines comprising micron and submicron sized particles and a recovered, regenerated catalyst stream which is discharged down into said regeneration means; recycling to said cracking reactor said regenerated cracking catalyst from said regeneration means; discharging from said regeneration means said regenerator flue gas comprising catalyst fines comprising micron and submicron sized particles; recovering catalyst fines from said flue gas discharged from said regeneration means by inertial separation, gravity settling and filtration in a single separator vessel having vertical cylindrical sidewalls, a diameter, a vertical axis, a top and a base; a vertical cylindrical insert within said vessel having an insert diameter, a top, a bottom, and a vertical axis aligned with said vessel vertical axis and wherein the insert diameter is smaller than the vessel diameter, said insert forming an annulus between said insert and said cylindrical sidewalls of said vessel; at least one tangential vapor inlet for said flue gas discharged from said regenerator passing through said vessel cylindrical sidewalls into said annulus at an elevation between said top and said base of said cylindrical insert; and inertially separating at least a majority of the particles having a diameter greater than 1 micron by tangential entry of said vapor into said annulus to produce a vapor with a reduced content of 1 micron particles relative to vapor in the tangential inlet; discharging vapor from said annulus via a vapor overflow opening between the top of said insert and the top of said vessel for radial out-to-in vapor flow from said annulus over said insert into an upper, interior portion of said vessel; discharging inertially separated solids from said annulus into said bottom portion of said vessel via a solids underflow opening between the bottom of said insert and the bottom of said vessel; and gravity settling of particulates from said produced vapor by drawing down produced vapor from said upper interior portion of said vessel into a plurality of vertical, cylindrical filters within an interior portion of said vessel and within an interior portion of said insert, and wherein said filters are beneath said upper, interior portion of said vessel for downflow of at least a portion of vapor from said overflow opening to an outer surface of said vertical filters, causing at least a portion of entrained particulates to settle and fall down around said vertical filters to said bottom of said vessel; filtering entrained sub-micron particulates by passing vapor into the outer surface of said filters to form a layer of filtered particulates on said outer surface and withdrawing from an interior portion of said filters a clean flue gas stream; at least periodically dislodging said layer of filtered particulates from said filters and allowing resulting dislodged particulates to fall into said bottom portion of said vessel; and collecting particulates recovered by inertial forces in said annulus, gravity settling around said vertical filters, and filtration on and dislodged from said vertical filters in said base portion of said vessel and at least periodically removing said collected particulates from said vessel.

In an apparatus embodiment, the present invention provides a dust/vapor separator comprising a separator vessel having vertical cylindrical sidewalls, a diameter, a vertical axis, a top and a base; a vertical cylindrical insert within said vessel having an insert diameter, a top, a bottom, and a vertical axis aligned with said vessel vertical axis and wherein the insert diameter is smaller than the vessel diameter, said insert forming an annulus between said insert and said cylindrical sidewalls of said vessel; at least one tangential vapor inlet for a stream of dust and vapor passing through said cylindrical sidewalls into said annulus at an elevation between said top and said base of said sidewalls; a vapor overflow opening between the top of said insert and the top of said vessel for radial out-to-in vapor flow from said annulus into an upper, interior portion of said vessel; a solids underflow opening between the bottom of said insert and the bottom of said vessel for discharge of dust from said annulus into said bottom portion of said vessel; a plurality of filtration means within an interior portion of said insert and wherein at least a portion of said filtration means are beneath said upper, interior portion of said vessel for downflow of at least a portion of vapor from said overflow opening to an outer surface of said filtration means; a vapor outlet for vapor with a reduced dust content connective with an interior portion of said filtration means and passing through said vessel; and a dust outlet in said base portion of said vessel.

DETAILED DESCRIPTION

Figure 1:
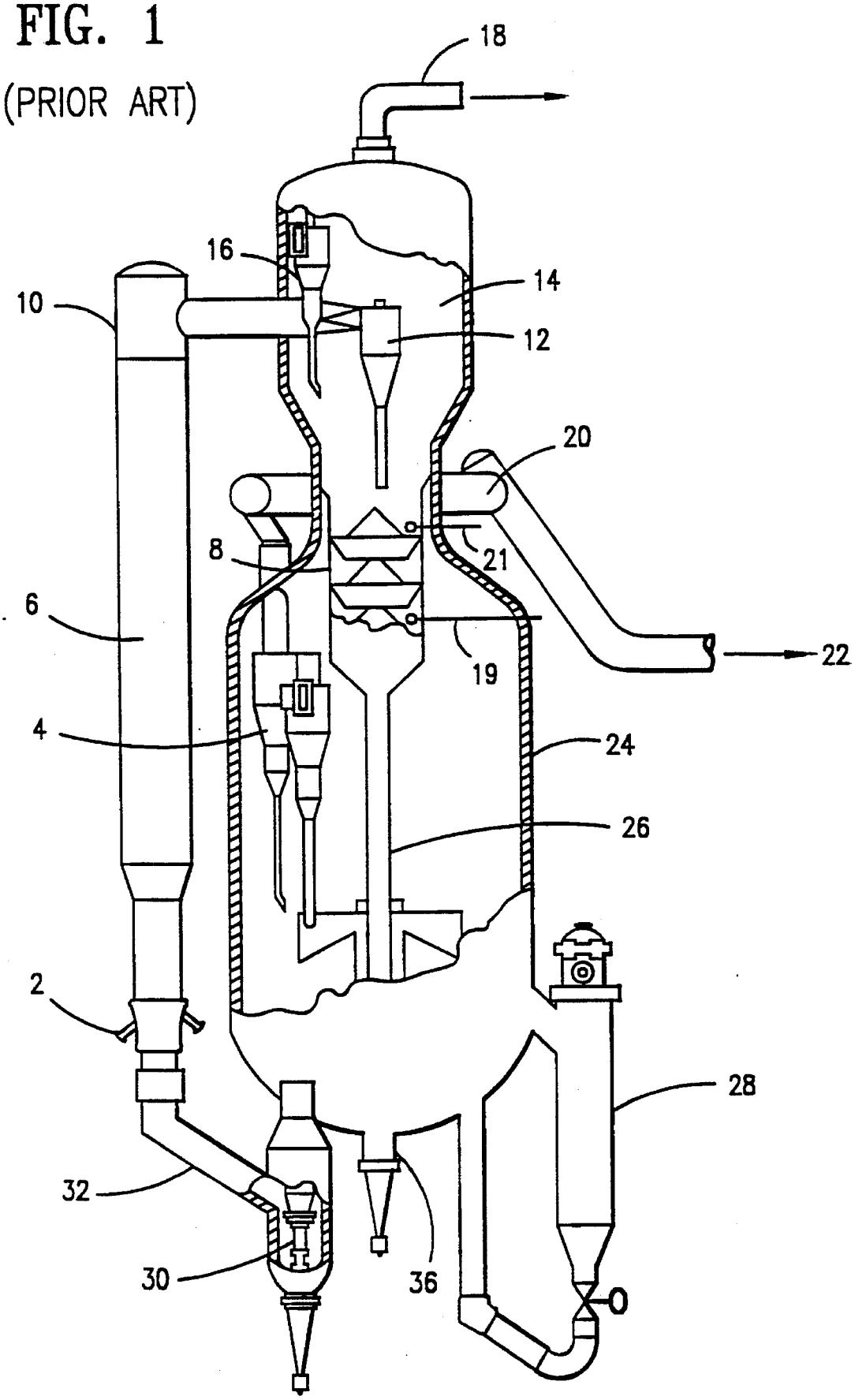
FIG. 1 (PRIOR ART)
FIG. 1 (prior art) is a simplified schematic view of an FCC unit of the prior art.

The present invention can be better understood by reviewing it in conjunction with a conventional riser cracking FCC unit. FIG. 1 illustrates a fluid catalytic cracking system of the prior art, and is similar to the Kellogg Ultra Orthoflow converter Model F shown as FIG. 17 of Fluid Catalytic Cracking Report, in the Jan. 8, 1990 edition of *Oil & Gas Journal*. There are myriad other FCC units which can benefit from the process of the present invention, but the process of the present invention works very well with this type of FCC unit.

A heavy feed such as a gas oil, vacuum gas oil is added to riser reactor 6 via feed injection nozzles 2. The cracking reaction is almost completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14 and eventually is removed via upper cyclones 16 and conduit 18 to the fractionator.

Spent catalyst is discharged down from a dipleg of riser cyclones 12 into catalyst stripper 8 where one, or preferably 2 or more, stages of steam stripping occur, with stripping steam admitted by means 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so heat may be removed from the regenerator if desired. Regenerated catalyst is withdrawn from the regenerator via regenerated catalyst plug valve assembly 30 and discharged via lateral 32 into the base of the riser reactor 6 to contact and crack fresh feed injected via injectors 2 as previously discussed. Flue gas, and some entrained catalyst, is discharged into a dilute phase region in the upper portion of regenerator 24. Entrained catalyst is separated from flue gas in multiple stages of cyclones 4 and discharged via outlets 38 into plenum 20 for discharge to the flue gas line via line 22.

This regenerator is ideal for the practice of the present invention. The bubbling dense bed in such a regenerator exhibits excellent horizontal mixing, and the heat exchanger 28 allows full CO burn operation even with heavy feeds.

FIG. 1 does not show a third stage separator. Line 22 in most refineries would go to some type of third stage separator (not shown), usually one involving 50 or 100 small diameter horizontal cyclones. Purified flue gas would then pass through an optional power recovery turbine (not shown) then go to a stack for discharge to the atmosphere.

Figure 2:
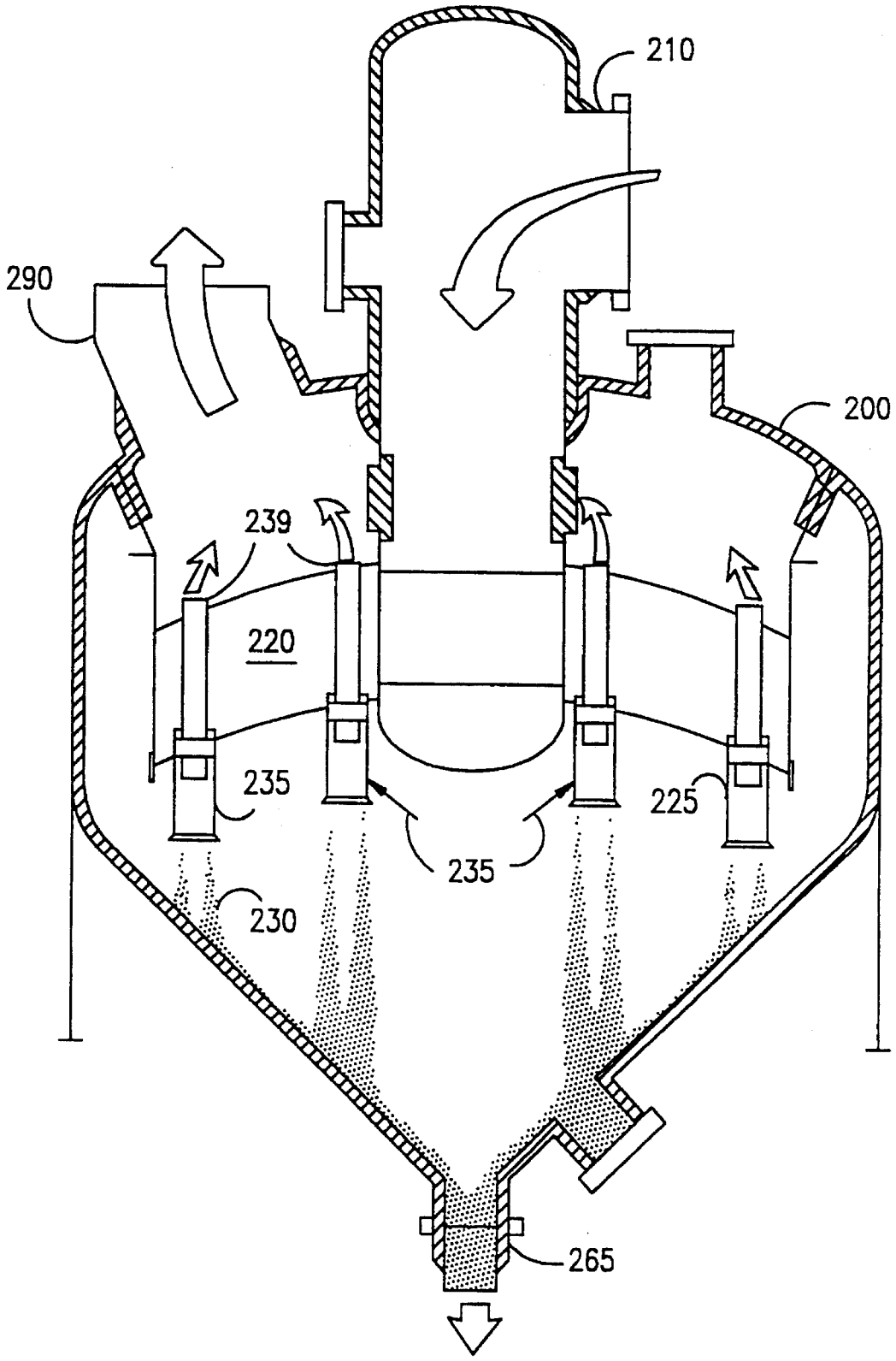
FIG. 2 (PRIOR ART)
FIG. 2 (prior art) is a simplified schematic view of a third stage separator of the prior art.

FIG. 2 (Prior Art) is similar to FIG. 1 of Improved hot-gas expanders for cat cracker flue gas, Hydrocarbon Processing, March 1976, p. 141. This article is incorporated by reference.

Third stage separator 200 receives a fines containing FCC flue gas via inlet 210. Gas is distributed via plenum 220 to the inlets of a plurality of small diameter ceramic tubes 235 containing swirl vanes not shown. Fines collect on the walls of tubes 235 and are discharged from the base of the tubes as an annular stream of solids 230. A clean gas stream is withdrawn via outlet tubes 239 to be removed from the vessel via outlet 290. Solids are removed via solids outlet 265.

Figure 3:
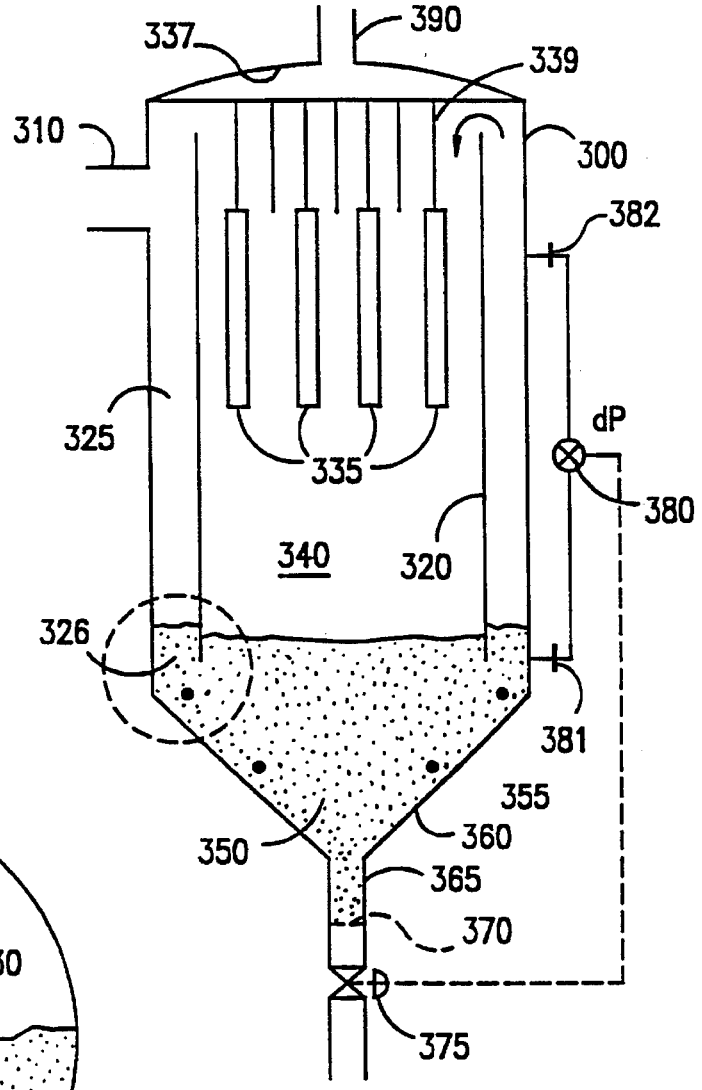
FIG. 3 (invention) is a sectional view of a preferred inertial and filtering separator of the invention.

FIG. 3 (invention) shows a cross-sectional view of our third stage separator. A mixture of flue gas and entrained fines enters via tangential inlet 310 of third stage separator 300. The mixture flows through an annular region defined by inner wall 320 and the cylindrical sidewall of vessel 300. A significant amount of inertial separation takes place in the annular region 325, with much of the entrained particulates falling down to outlet 326 sealed by immersion in bubbling fluidized bed 350.

Figure 5:
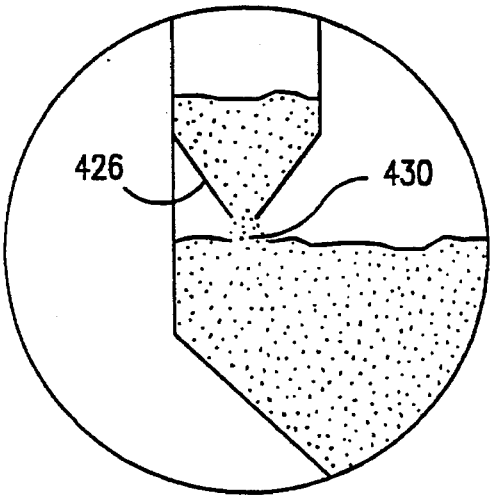
FIG. 5 illustrates an alternate arrangement for that portion of the apparatus encircled in FIG. 3.

FIG. 5 shows an alternative design using converging side members 426 at the base of the annular region discharging via outlet 430. Other seal means, such as a plurality of orifice outlets, flapper valves, etc may be used, but sealing by immersion is preferred.

In the embodiment shown in FIG. 3 sufficient catalyst is maintained in vessel 300 to seal the base of the annular insert. Differential pressure control 380, with upper and lower pressure taps 382 and 381, respectively, sends a signal to slide valve 375 to regulate catalyst withdrawal to maintain the desired amount of catalyst, fines, dust, etc in region 350. A plurality of aeration rings 355 keep bed 350 fluidized. The base of vessel 360 comprises a conical section 360 leading to fluidized solids outlet 365.

Vapor flows, with some entrained particulates, over the top of inner wall 320 in generally out-to-in radial flow, with a significant downward component. In this way, the force of gravity encourages entrained particles to settle down, and reduces to some extent the loading on the plurality of filter elements 335. Substantially dust free gas is removed from the tops of elements 335, passes via lines 339 into plenum 337 to eventually be removed via gas outlet 390.

Figure 4:
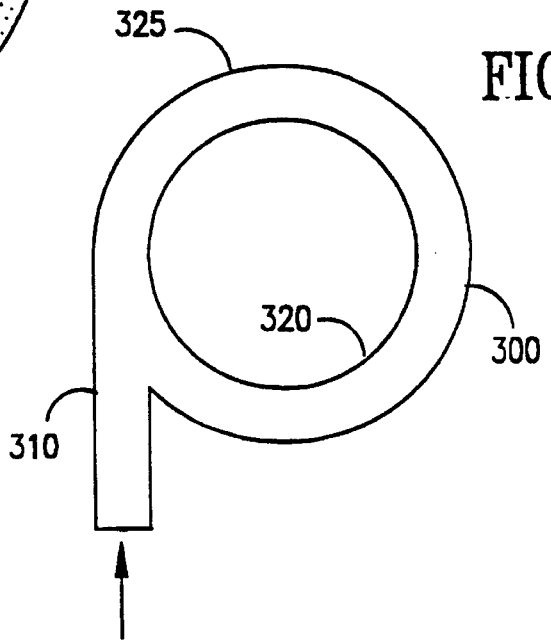
FIG. 4 is a plan view of the FIG. 3 separator.

FIG. 4 shows a top or plan view of the FIG. 3 separator.

Like elements in FIGS. 3 and 4 have like reference numerals.

Preferably each filter element, or cluster of filter elements, has conventional back-pressure means to dislodge fines accumulating on the filter element. Alternatively, multiple vessels 300 can be provided in parallel so that periodically dust may be dislodged.

Having provided an overview of the FCC process and the new cyclone design, a detailed review of the FCC process and of preferred filter elements and design features follows.

FCC FEED

Any conventional FCC feed can be used. The feeds may range from typical petroleum distillates or residual stocks, either virgin or partially refined, to coal oils and shale oils. The feed frequently will contain recycled hydrocarbons, such as light and heavy cycle oils which have already been cracked. Preferred feeds are gas oils, vacuum gas oils, atmospheric resids, and vacuum resids. Most feeds will have an initial boiling point above about 650° F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 wt % RE.

The catalyst inventory may contain one or more additives, either as separate additive particles, or mixed in with each particle of the cracking catalyst. Additives can enhance octane (shape selective zeolites, typified by ZSM-5, and other materials having a similar crystal structure), absorb SOX (alumina), or remove Ni and V (Mg and Ca oxides). The FCC catalyst composition, per se, forms no part of the present invention.

FCC REACTOR CONDITIONS

Conventional cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 5 seconds, and most preferably about 0.75 to 4 seconds, and riser top temperatures of 900° to about 1050° F.

It is preferred, but not essential, to use an atomizing feed mixing nozzle in the base of the riser reactor, such as the Atomax Nozzle available from the M. W. Kellogg Co. More details about the nozzle are disclosed in U.S. Ser. No. 08/066,595, which is incorporated by reference.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 5,055,177 to Haddad et al.

It is preferred, but not essential, to use a hot catalyst stripper. Hot strippers heat spent catalyst by adding some hot, regenerated catalyst to spent catalyst. Suitable hot stripper designs are shown in U.S. Pat. Nos. 3,821,103 and 4,820,404, incorporated by reference.

The FCC reactor and stripper conditions, per se, can be conventional.

CATALYST REGENERATION

The process and apparatus of the present invention can use conventional FCC regenerators. Most regenerators are either bubbling dense bed or high efficiency. The regenerator, per se, forms no part of the present invention.

A high efficiency regenerator, such as is shown in several of the patents incorporated by reference, also works very well. These have a coke combustor, a dilute phase transport riser and a second dense bed with recycle of some regenerated catalyst to the coke combustor. Preferably, a riser mixer is used. These are widely known and used.

Two stage regenerators, usually associated with resid crackers, involve a first stage regeneration at relatively low temperature and relatively high steam partial pressure, with a second stage at higher temperature at drier conditions.

Regenerator conditions usually include a temperature of 1200° to 1800° F., preferably 1300° to 1450° F., a pressure of atmospheric to 3 or 4 atmospheres. They may operate in either full or partial CO combustion mode.

THIRD STAGE SEPARATOR

The apparatus of the invention is preferably used as a third stage separator removing catalyst and fines from regenerator flue gas. Our separator will preferably be the only fines/gas separation means intermediate the FCC regenerator and the stack and/or any power recovery turbine that may be present.

There are at least two major separation mechanisms in play in our device, inertial and filtration and a minor amount of gravity settling. The inertial separator effects a significant amount of rough cut separation and simultaneously distributes incoming gas in a way which improves the effectiveness of the filtration separator. The generally downflow feed of the filters achieves a modest degree of gravity fines separation, and facilitates intermittent pulse cleaning of the filters, if such filter cleaning method is desired.

Both the inertial separator and filter must be in the same vessel, and must work together as discussed below.

INERTIAL SEPARATOR/GAS DISTRIBUTOR

The flue gas stream from the FCC regenerator must be tangentially charged to an annular region with a third stage separator vessel. Although the incoming gas may be added via a plurality of inlets, 3, 4 or even more, the benefits will not usually justify the cost. Thus a single, usually quite large, vapor line, will discharge gas from the FCC regenerator tangentially into the third stage separator vessel. This line is preferably horizontal to reduce fabrication costs. Depending on the relative elevation of the tangential inlet to the height of the annular region, the line may point slightly up or down.

If the tangential inlet is in the lower ½ of the annular region, a slight upward discharge will increase the length of the trajectory followed by solid particles, minimize re-entrainment of settled particles, and promote annular discharge of gas with a reasonably constant composition. If the tangential inlet is in the upper ½ of the annular region, a slight downward trajectory will augment particle/gas separation. Commercially, it will usually be optimum to add the gas horizontally, and to a location in the upper 15–40% of the annular region.

The annular region should be sealed at the base, preferably by immersion in a bed of fluidized solids or by means of flow constrictions, orifice outlets, spring loaded flappers or the like.

The annular region must be open at the top, permitting flow up and over the annular region into an upper portion of the third stage separator vessel.

Preferred ratios of various parts of the device are summarized below, based on a third stage separator with a vapor inlet line 310 of 1.0 m diameter. All dimensions are meters.

| | Good | Better | Best |
|---|---|---|---|
| Inlet, | 1 | | |
| Vessel D, | 3–20 | 4–14 | 6–8 |
| Vessel Height | 3–25 | 4–18 | 8–12 |
| Annular space | 0.1–2 | 0.2–1 | 0.3–0.6 |
| Annular overflow | 0.1–3 | 0.2–2 | 0.3–1 |
| Annular underflow | Sealed | Sealed | Sealed |

Vessel height is the vertical height of the cylindrical portion of the vessel, exclusive of weldcaps or other closure means on the top or bottom of the vessel.

Annular space refers to the area available for fluid flow in the annular space between the wall of the third stage separator vessel and the annular insert 320.

Annular space refers to the area available for fluid flow over the top of the annular insert into the inner space of the vessel containing the filter elements.

FILTRATION MEANS

We prefer to operate with a plurality of rigid, porous solid filter elements, but can also use bag filters if the gas can be cooled.

Porous solid filter elements, such porous stainless steel, or other sintered metal filters or porous ceramic filters are the filtration means of choice.

Sintered metal and porous ceramic filter elements are available from vendors such as Pall.

Because of the large gas volumes involved, and the need for a large face surface are for the porous solid filter elements, it may be beneficial to cluster 2-6-9 or even more elements by connecting them via a common clean vapor outlet manifold.

Each filter element, or cluster of elements, preferably has associated with it a cleaning means, preferably a reverse pulse gas cleaning means. These are available from many vendors including Pall.

Enough filter elements should be provided so that the face velocity, defined as the cubic feet of gas per second/(square feet of filter area) is less than 20 fps, and preferably less than 12 fps, and most preferably 4–8 fps.

A poor alternative is to provide a mechanical shaking means, or provisions for some reverse flow of gas, to dislodge collected dust and fines.

Bag or fabric filters can usually only be used when the regenerator flue gas has been cooled below 6000° F., and preferably below 400° F. When a refiner has a dust problem, but no power recovery turbine, the regenerator flue gas can be cooled upstream of the third stage separator sufficiently to permit use of various fabrics. More details about this type of equipment may be taken from the section on Fabric Filters, DUST-COLLECTION EQUIPMENT, Perry's Chemical Engineers' Handbook, Sixth Edition, 20–97 to 20–104, which is incorporated by reference.

DISCUSSION

The new design is easy to fabricate using conventional techniques. The device significantly improves removal of fine dust, that is, 0–2 micron particles, and especially below 1 micron particles. Our design can essentially eliminate erosion on power recovery turbine blades, and/or reduce particulates emissions from FCC regenerators by over 50%. Our device may be easily added to existing commercial installations to significantly enhance efficiency.

Although significant capital expense is required, the benefits from reduced particulates emissions justify the cost involved.

The efficiency of our design is sufficient to eliminate most, and in most cases more than 90%, of the particulates emitted by existing third stage separators. We can use our device to replace existing third stage separators and forth stage separators. Our device can tolerate large surges in catalyst carryover, without creating damaging and upsetting pressure surges which work back through the FCC unit.

We claim:

1. A fluidized catalytic cracking process wherein a heavy feed is catalytically cracked to lighter products comprising:

cracking said feed with a stream of regenerated cracking catalyst having an average particle size within the range of 60–80 microns in a cracking reactor to produce lighter products and spent catalyst;

separating products from spent catalyst;

stripping spent catalyst with steam to produce stripped catalyst;

regenerating said stripped catalyst in a catalyst regeneration means by contact with an oxygen containing gas to produce regenerated catalyst and flue gas containing entrained catalyst and fines;

recycling to said cracking reactor said regenerated cracking catalyst;

recovering entrained catalyst from flue gas by passing said flue gas through at least one stage of cyclone separation to produce a regenerator flue gas which is essentially free of entrained catalyst having a particle size greater than 20 microns but containing entrained catalyst fines comprising micron and submicron sized particles;

separating entrained fines from said produced regenerator flue gas containing fines comprising micron and submicron catalyst particles by inertial separation and filtration in a single separator vessel having:

vertical cylindrical sidewalls, a diameter, a vertical axis, a top and a base; and a vertical cylindrical insert within said vessel having an insert diameter, a top, a bottom, and a vertical axis aligned with said vessel vertical axis and wherein the insert diameter is smaller than the vessel diameter, said insert forming an annulus between said insert and said cylindrical sidewalls of said vessel;

at least one tangential vapor inlet for said produced regenerator flue gas passing through said vessel cylindrical sidewalls into said annulus at an elevation between said top and said base of said cylindrical insert;

a vapor overflow opening between the top of said insert and the top of said vessel for radial out-to-in vapor flow from said annulus into an upper, interior portion of said vessel;

a solids underflow opening between the bottom of said insert and the bottom of said vessel for discharge of solids from said annulus into said bottom portion of said vessel;

a plurality of filtration means within said vessel and within said insert, said filtration means having an interior portion and a porous outer surface at least partially beneath said upper, interior portion of said vessel and said top of said insert for downflow of vapor from said overflow opening past said outer surface of said filtration means;

a vapor outlet for vapor with a reduced solids content connective with said interior portion of said filtration means and passing through said vessel; and a solids outlet in said base portion of said vessel inertially separating said produced regenerator flue gas by tangential entry into said annulus to produce:

a solids underflow stream which is discharged down from said annulus via said solids underflow opening; and a vapor with a reduced content of particulates relative to vapor added by said tangential entry, which is discharged up from said annulus and over said insert; and filtering said vapor with a reduced content of particulates by contact with said outer surface of said filtration means to produce:

a clean flue gas stream which is withdrawn from said interior portion of said filtration means; and a layer of filtered particulates which builds up on said outer surface of said filtration means; and at least periodically dislodging said layer of particulates from said filters into said base portion of said vessel;

at least periodically removing inertially separated solids and solids dislodged from said filtration means from said base portion of said vessel; and removing said clean flue gas stream from said vessel via said vapor outlet for vapor with a reduced solids content connective with said interior portion of said filtration means and passing through said vessel.

2. The process of claim 1 wherein said annulus has a horizontal cross sectional area and said solids underflow opening comprises an opening of reduced cross sectional area relative to annulus.

3. The process of claim 1 wherein said separator vessel has a solids level sensing and control means for maintaining a level of collected solids in said base portion of said vessel sufficient to cover and seal said bottom of said insert.

4. The process of claim 3 wherein said filtration means comprise vertically disposed, cylindrical, porous metal filter.

5. The process of claim 1 wherein said filtration means comprise vertically disposed, cylindrical, porous ceramic filters.

6. The process of claim 1 wherein said filtration means is a fabric filter.

7. A fluidized catalytic cracking process wherein a heavy feed is catalytically cracked to lighter products comprising:

cracking said feed by contact with a stream of regenerated cracking catalyst having an average particle size within the range of 60–80 microns in a cracking reactor to produce cracked products and spent catalyst;

separating products from spent catalyst;

stripping spent catalyst with steam to produce stripped catalyst;

regenerating said stripped catalyst in a catalyst regeneration means by contact with an oxygen containing gas to produce regenerated catalyst and flue gas containing entrained catalyst and fines;

recovering entrained catalyst from regenerator flue gas by passage through at least one stage of cyclone separation to produce a regenerator flue gas which is essentially free of entrained catalyst having a particle size greater than 20 microns but containing entrained catalyst fines comprising micron and submicron sized particles and a recovered, regenerated catalyst stream which is discharged down into said regeneration means;

recycling to said cracking reactor said regenerated cracking catalyst from said regeneration means;

discharging from said regeneration means said regenerator flue gas comprising catalyst fines comprising micron and submicron sized particles;

recovering catalyst fines from said flue gas discharged from said regeneration means by inertial separation, gravity settling and filtration in a single separator vessel having:

vertical cylindrical sidewalls, a diameter, a vertical axis, a top and a base;

a vertical cylindrical insert within said vessel having an insert diameter, a top, a bottom, and a vertical axis aligned with said vessel vertical axis and wherein the insert diameter is smaller than the vessel diameter, said insert forming an annulus between said insert and said cylindrical sidewalls of said vessel;

at least one tangential vapor inlet for said flue gas discharged from said regenerator passing through said vessel cylindrical sidewalls into said annulus at an elevation between said top and said base of said cylindrical insert; and inertially separating at least a majority of the particles having a diameter greater than 1 micron by tangential entry of said vapor into said annulus to produce a vapor with a reduced content of 1 micron particles relative to vapor in the tangential inlet;

discharging vapor from said annulus via a vapor overflow opening between the top of said insert and the top of said vessel for radial out-to-in vapor flow from said annulus over said insert into an upper, interior portion of said vessel;

discharging inertially separated solids from said annulus into said bottom portion of said vessel via a solids underflow opening between the bottom of said insert and the bottom of said vessel; and gravity settling of particulates from said produced vapor by drawing down produced vapor from said upper interior portion of said vessel into a plurality of vertical, cylindrical filters within an interior portion of said vessel and within an interior portion of said insert, and wherein said filters are beneath said upper, interior portion of said vessel for downflow of at least some vapor from said overflow opening around said vertical filters, causing at least a portion of entrained particulates to settle and fall down around said vertical filters to said bottom of said vessel;

filtering entrained sub-micron particulates by passing vapor through the outer surface of said filters to form a layer of filtered particulates on said outer surface and withdrawing from an interior portion of said filters a clean flue gas stream;

at least periodically dislodging said layer of filtered particulates from said filters and allowing resulting dislodged particulates to fall into said bottom portion of said vessel; and collecting particulates recovered by inertial forces in said annulus, gravity settling around said filters, and filtration on and dislodged from said filters is said base portion of said vessel and at least periodically removing said collected particulates from said vessel.

8. The process of claim 7 wherein the filters are porous metal or ceramic filters.

9. The process of claim 7 wherein the filters are porous stainless steel.

* * * * *